United States Patent [19]

Nagelkerke

[11] 4,260,871

[45] Apr. 7, 1981

[54] HANDLE FOR HOLDING, HEATING AND MANIPULATING SUCCESSIVELY APPLIED HAIR ROLLERS

[75] Inventor: Petrus J. J. Nagelkerke, Drachten, Netherlands

[73] Assignee: U.S. Philips Corporation, New York, N.Y.

[21] Appl. No.: 884,745

[22] Filed: Mar. 9, 1978

[30] Foreign Application Priority Data

Apr. 12, 1977 [NL] Netherlands ..... 7703945

[51] Int. Cl.[3] ..... H05B 1/00; A45D 4/16

[52] U.S. Cl. ..... 219/222; 132/9; 132/33 R; 132/33 F; 132/34 R; 132/39; 219/214; 219/241; 219/242; 219/521; 221/150 A; 221/185; 221/312 A

[58] Field of Search ..... 219/222–226, 219/214, 241, 221, 227, 242, 230, 521; 221/150 R, 150 A, 185, 312 A; 132/39, 40, 9, 41 R, 41 A, 41 B, 41 C, 33 R, 33 A, 33 B, 33 C, 33 D, 33 E, 33 F, 33 G, 34 R, 34 A, 36 R, 36 A, 36 AA, 36 B, 36 C, 36 CC, 36 D, 38 R

[56] References Cited

U.S. PATENT DOCUMENTS

| | | | |
|---|---|---|---|
| 1,544,713 | 7/1925 | Ackley | 132/33 R X |
| 1,995,618 | 3/1935 | Lakembach | 219/222 X |
| 2,445,026 | 7/1948 | Frank | 221/185 |
| 2,908,791 | 10/1959 | Torino et al. | 219/214 |
| 3,389,708 | 6/1968 | Reyes | 132/34 R |
| 3,483,876 | 12/1969 | Planel | 132/33 R |
| 3,626,150 | 12/1971 | Kress | 219/242 X |
| 3,719,792 | 3/1973 | Cuccaro | 219/230 |
| 4,136,275 | 1/1979 | McCullough | 219/230 |

FOREIGN PATENT DOCUMENTS

| | | | |
|---|---|---|---|
| 637832 | 11/1936 | Fed. Rep. of Germany | 219/222 |
| 429492 | 6/1948 | Italy | 132/33 R |
| 617257 | 2/1949 | United Kingdom | 219/242 |

*Primary Examiner*—A. Bartis

*Attorney, Agent, or Firm*—T. A. Briody; W. J. Streeter; R. E. Schneider

[57] ABSTRACT

A hair roller holder comprises an elongated hollow handle defining a chamber for successively accommodating a plurality of hair rollers. Associated with the chamber is an arrangement for electrically heating the rollers therein. The chamber has an inlet opening at one end for insertion of the rollers in unheated condition and an outlet opening at the other end for discharge of the rollers in heated condition. Adjacent such outlet opening and externally of the chamber is a support for receiving a heated roller in a manner so that hair can be wrapped onto the roller and the roller can be manipulated by the handle. Provision is made in the chamber for guiding movement of the successive rollers therethrough onto the support. The movement guiding means may comprise guide pins in the chamber upon which the rollers are slidable and which are provided with electric heating elements for heating the rollers.

5 Claims, 5 Drawing Figures

HANDLE FOR HOLDING, HEATING AND MANIPULATING SUCCESSIVELY APPLIED HAIR ROLLERS

This invention relates to a hair roller holder provided with means for heating the roller.

Conventionally hair rollers are heated one by one or several at a time in a box-shaped housing, after which they are ready to be put in by hand. The disadvantage of this is that the rollers are generally too hot to be hand-held. U.S. Pat. No. 3,594,543 describes a hair roller whose surface remains cold for an instant immediately after the roller has been heated, but this eliminates the problem only partly, because briefly afterwards this surface still becomes warm.

It is an object of the present invention to provide a hair roller holder, by means of which said disadvantage is circumvented, and the invention is characterized in that the holder comprises a handle, as well as means associated with the handle for supporting the roller in a wrapping position in which the hair can be wrapped onto the roller.

The heated roller can now be put in with the aid of the holder, so that it is not necessary to touch the hot roller with the hand. Subsequently, the roller can be removed from the holder.

A special embodiment is characterized in that in the wrapping position the roller is rotatable relative to the holder.

Desirably, the hair roller holder holds a plurality of rollers at the same time and is provided with a transport mechanism for the transfer of each roller from the heating position to the wrapping position.

A preferred embodiment is characterized in that the holder has an oblong hollow shape with an inlet opening for the roller at one end and an outlet opening at the other end, the supporting means being disposed at said last-mentioned end. Owing to the oblong shape of the holder an easy-to-handle appliance is obtained.

Another preferred embodiment is characterized in that the supporting means comprises at least one pin which projects from the housing in the longitudinal direction.

Yet another embodiment is characterized in that the transport mechanism comprises guide pins, which are disposed substantially in the longitudinal direction of the hollow holder, along which pins the roller is moved.

The roller holder is ordinarily provided with an electric heating element for heating the roller, the guide pins preferably forming part of the heating element.

In such case the holder is preferably equipped with a rotatable electrical connector.

The invention also relates to a roller for use with such a hair roller holder, the cylindrical surface of the roller then being formed with slots for the guide pins of the holder.

A further embodiment of the roller is characterized in that the roller contains a heating element.

Figure 1:
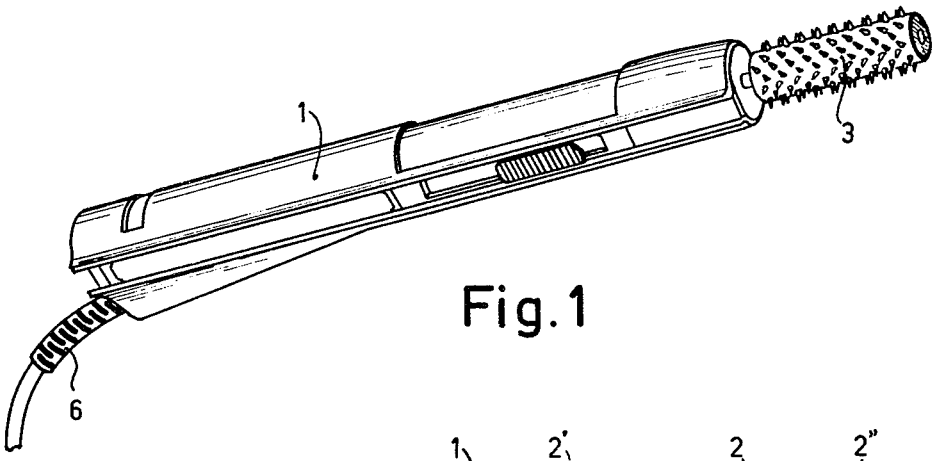
Figure 2:
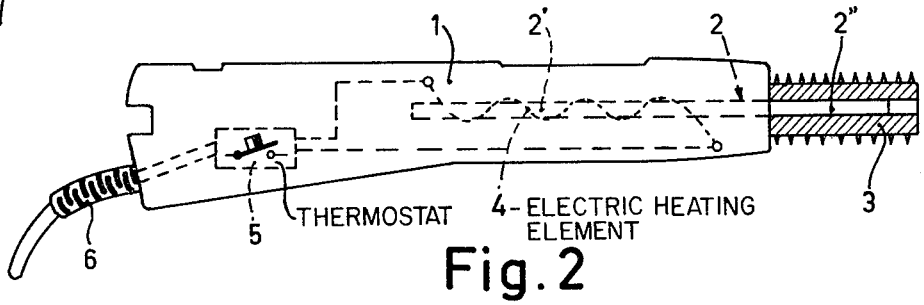
Figure 3:
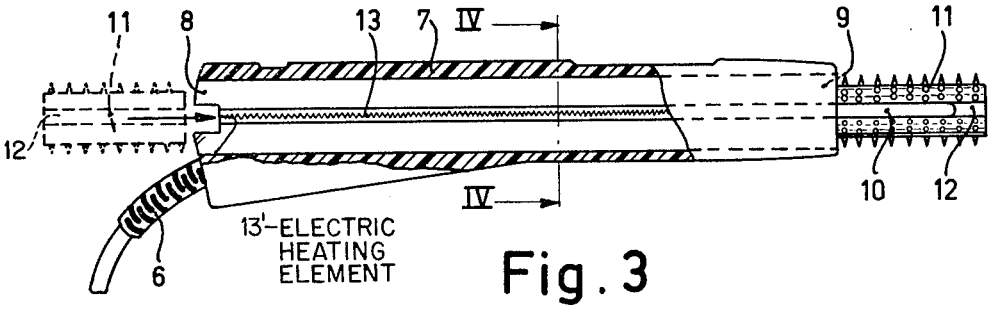
Figure 4:
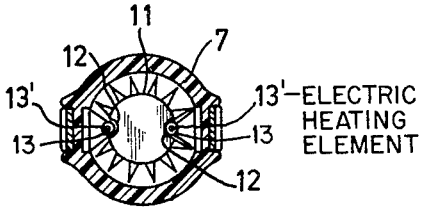
Figure 5:
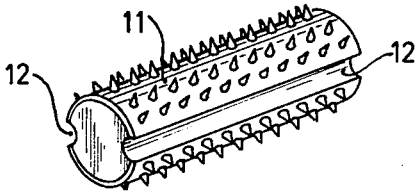

The invention will now be described in more detail with reference to the accompanying drawings in which:

FIG. 1 is a perspective view of a hair roller holder,

FIG. 2 schematically shows the hair roller holder of FIG. 1 in elevation,

FIG. 3 is a longitudinal section of a different embodiment of the hair roller holder, FIG. 4 is a cross-section on an enlarged scale taken on the line IV—IV in FIG. 3, and FIG. 5 shows on an enlarged scale and in perspective a roller for use with the holder of FIGS. 3 and 4.

The hair roller holder shown in FIGS. 1 and 2 comprises a handle 1, in which a part 2′ of a pin 2 of a thermally conductive material is located. A part 2″ of the pin projects from the handle and serves as a supporting means for a roller 3. The part 2′ is provided with an electric heating element 4. The temperature of the pin 2 can be controlled with a thermostatic switch 5. The appliance can be connected to a voltage source by means of the connecting lead 6.

The operation of the appliance is as follows. The roller 3 is fitted on to the part 2″ of the pin in non-heated condition. For this purpose the roller has a bore which corresponds to the cross-section of the pin. If the heating element 4 is connected to a voltage source part 2′, and owing to conduction also part 2″, of the pin will be heated. Finally the roller is also heated owing to heat transfer between part 2″ and the roller 3. When the roller has a sufficiently high temperature the roller can be brought to the hair to be treated with the aid of the holder and whilst the hair is wrapped onto the roller it does not leave the wrapping position on part 2″ of the pin.

When the hair has been wrapped onto the roller the roller can simply be slid off part 2″ of the pin and the next roller can be fitted onto the holder. In this way it is avoided that the heated rollers have to be touched by hand.

By giving part 2″ of the pin a circular cross-section the roller can be rotatable about this part 2″ in the wrapping position. Rotatably suporting the roller on the holder may facilitate wrapping the hair onto the roller.

The pin 2 may also have a different cross-section, for example rectangular or elliptical and, in addition, more pins may be used. Obviously, the rollers should then have corresponding bores.

In the embodiment in accordance with FIGS. 3 and 4 the handle 7 has a hollow oblong shape with an inlet opening 8 at the end at the rear and an outlet opening 9 at the end at the front. At the front of the holder two confronting pins 10 are disposed as supporting means for the roller. Between the pins 10 a roller 11 can be retained in a wrapping position outside the holder. For this purpose two slots 12 are formed in the outer circumference of the roller 11, with which the pins 10 engage (also see FIG. 5). For the transport of the roller 11 through the hollow handle 7 the handle is internally provided with two guide pins 13. The size and location of guide pins 13 relative to each other correspond to those of the slots 12 of the roller 11, these guide pins being disposed in line with the pins 10 which project from the handle 7.

The guide pins 13 also serve for heating the rollers and are each provided with an electric heating element 13′, which extends from connecting lead 6. The guide pins 13 may also take the form of heating elements of a material with a positive temperature coefficient.

Preferably guide pins 13 are integral with projecting pins 10.

The operation of the appliance is as follows. A roller 11 is slid into the holder onto guide pins 13 at the inlet opening 8. During transport of the roller 11 through the handle 7 on pins 13 the roller 11 is heated. When the roller is sufficiently warm, it can be slid between the pins 10 outside the housing. Subsequently, the roller can be wrapped with hair by means of the holder without the warm roller being touched by hand. The handle 7 may contain a plurality of rollers at the same time.

The rollers may for example be transported by sliding a roller into the opening 8 at the back of the handle 7, so that the rollers already contained in the handle are advanced and the roller which is disposed in front of the outlet opening 9 is pushed out of the handle and in between the pins 10.

The rollers may also be transported in a different manner, for example by rotating a threaded transport spindle, which transport spindle is disposed in the space inside the handle, the thread engaging with corresponding threaded portions on the rollers.

In the embodiments described hereinbefore the heating element may also be accommodated in the roller instead of in the handle. Both the roller and the holder should then be provided with contact members for the connection of the element to a voltage source.

If whilst the hair is wound onto the roller the holder is to be rotated a few times it may be useful to provide the holder with a rotatable electrical connector of a type known per se.

In order to obtain an indication of the temperature the rollers may locally be provided with a type of paint which changes colour when a specific temperature is reached.

Further the appliance may be provided with a switch and a pilot lamp in known manner.

What is claimed is:

1. A hair roller holder comprising an elongated hollow handle defining a chamber for accommodating a plurality of hair rollers in succession, means associated with said chamber for heating said rollers while successively accommodated therein, said chamber having an inlet opening at one end for insertion thereinto of said rollers in unheated condition and an outlet opening at the other end for discharge therefrom of said rollers in heated condition, means associated with the handle adjacent said outlet opening in a manner for releasably receiving and supporting a heated roller externally of the chamber in a position in which hair can be wrapped onto the roller and the roller can be manipulated by the handle, and means provided in said chamber for guiding movement of the successive rollers therethrough from the heating position in said chamber to the wrapping position on said supporting means.

2. A hair roller holder according to claim 1, in which the hollow handle chamber has an oblong cross section.

3. A hair roller holder according to claim 1, in which the supporting means comprises support pins projecting from the hollow handle in the longitudinal direction.

4. A hair roller holder according to claim 1, in which the movement-guiding means comprises guide pins in said chamber disposed substantially in the longitudinal direction of the hollow handle, the rollers being successively slidable along such guide pins from said chamber onto said supporting means.

5. A hair roller holder according to claim 4, in combination with at least one hair roller in said chamber, each roller having lateral recesses corresponding to and slidably engageable with the guide pins.

* * * * *